US008635008B2

(12) United States Patent
Tsai

(10) Patent No.: US 8,635,008 B2
(45) Date of Patent: Jan. 21, 2014

(54) SYMMETRIC AND INTERLOCKED REGIONAL TRAFFIC LIGHT CONTROL METHOD

(76) Inventor: Hui-Te Tsai, Taipei (TW)

( * ) Notice: Subject to any disclaimer, the term of this patent is extended or adjusted under 35 U.S.C. 154(b) by 403 days.

(21) Appl. No.: 12/852,518

(22) Filed: Aug. 9, 2010

(65) Prior Publication Data

US 2011/0098909 A1 Apr. 28, 2011

(30) Foreign Application Priority Data

Oct. 27, 2009 (TW) ..... 98136268 A

(51) Int. Cl.
*G08G 1/07* (2006.01)

(52) U.S. Cl.
USPC ..... 701/119; 340/911

(58) Field of Classification Search
USPC ..... 701/119; 340/911, 932
See application file for complete search history.

(56) References Cited

U.S. PATENT DOCUMENTS 5,278,554 A * 1/1994 Marton ..... 340/910

* cited by examiner

*Primary Examiner* — Mary Cheung
*Assistant Examiner* — Yuen Wong

(57) ABSTRACT

A regional symmetric and interlocked traffic light control method includes: defining a first preferred point in a desired metropolitan area; determining a first axial average vehicle speed and a first axial preferred allowed travel time period for the first axial streets and a second axial average vehicle speed and a second axial preferred allowed travel time period for the second axial streets; obtaining a first vehicle travel distance and a second vehicle travel distance; determining a first control region according to the first preferred point, the first vehicle travel distance and the second vehicle travel distance; defining a second preferred point and a third preferred point adjacent to the first control region; controlling a plurality of traffic lights in the two adjacent control regions to respectively display green and red lights on the same axial streets in accordance with a preferred allowed travel time period and linking the traffic lights in said control regions by serializing. Therefore, a vehicle can pass through a plurality of adjacent control regions in accordance in its cruising speed and the traveling efficiency of the vehicle can be improved.

14 Claims, 15 Drawing Sheets

SYMMETRIC AND INTERLOCKED REGIONAL TRAFFIC LIGHT CONTROL METHOD

BACKGROUND OF THE INVENTION

1. Field of the Invention

The present invention relates to a regional symmetric and interlocked traffic light control method, and more particularly to a regional traffic light control method for reducing traffic jams in a plurality of traffic jam control areas for at least two adjacent regions.

2. Description of the Related Art

Currently, traffic lights are commonly used for many intersection in metropolitan areas to control traffic for both vehicles and pedestrians.

A typical traffic light control method for a metropolitan area controls a series of traffic lights along the same direction for a predetermined distance to display a green light or a red light continuously. Therefore, regardless of the traveling speeds of any vehicle, it will have to stop at a red light, which increases travel times. Moreover, when a large number of vehicles all stop and wait for a red light, serious air and noise pollution problems are consequently generated, and which also causes traffic jams.

In order to control traffic at an intersection having two axial traffic directions, according to statistics, the vehicle on each street needs to spend at least half of its travel time waiting for red lights. Furthermore, in general, a typical car with a full tank of gas can run about 500 km on highways but only 220 km in cities; in other words, about 56% of the fuel is wasted, which is a tremendous waste of energy.

Therefore, it is desirable to provide a regional traffic light control method for reducing metropolitan traffic jams so as to mitigate and/or obviate the aforementioned problems.

SUMMARY OF THE INVENTION

An objective of the present invention is to provide a symmetric and interlocked regional traffic light control method, which can reduce vehicle travel times, air pollution, noise pollution, and wasted fuel.

In order to achieve the above-mentioned objectives, a regional symmetric and interlocked traffic light control method comprises:

(A) defining a first preferred point in a desired metropolitan area, and dividing the desired metropolitan area into a plurality of first axial streets and a plurality of second axial streets based on the first preferred point;

(B) determining a first axial average vehicle speed and a first axial preferred allowed travel time period for the first axial streets and a second axial average vehicle speed and a second axial preferred allowed travel time period for the second axial streets based on the first preferred point;

(C) obtaining a first vehicle travel distance according to the first axial average vehicle speed and the first axial preferred allowed travel time period and obtaining a second vehicle travel distance according to the second axial average vehicle speed and the second axial preferred allowed travel time period;

(D) determining a first control region according to the first preferred point, the first vehicle travel distance and the second vehicle travel distance, and including the first axial streets and the second axial streets in the first control region;

(E) defining a second preferred point and a third preferred point adjacent to the first control region;

(F) utilizing step (E) to determine a second control region adjacent to the first control region based on the second preferred point, and including the first axial streets in the first control region and the second control region;

(G) utilizing step (F) to determine a third control region adjacent to the first control region based on the third preferred point, and including the second axial streets in the first control region and the third control region, the three control regions forming a web;

(H) controlling a plurality of traffic lights in the first control region to display green lights to the vehicles traveling on the first axial streets and red lights to the vehicles traveling on the second axial streets according to the first axial preferred allowed travel time period, and controlling a plurality of traffic lights in the second control region and the third control region to display red lights to the vehicles traveling on the first axial streets and green lights to the vehicles traveling on the second axial streets according to the second axial preferred allowed travel time period; and (I) linking the traffic lights in all the control regions by serializing.

Accordingly, vehicles traveling with the average vehicle speed move along the axial streets through the control region and the next control region. Therefore, when the vehicles in the control region move with the average vehicle speed they can all travel into another control region before the current allowing travel time period ends. In other words, vehicles in the control regions are able to travel through all connected control regions which can reduce vehicle travel times, air pollution, noise pollution, and wasted fuel.

The preferred point may be an intersection or a building.

The first axial streets and the second axial streets may be divided from the first preferred point based on a preferred direction.

The preferred direction may be geographic east, south, west or north.

The preferred direction may be the direction of the first axial streets or the second axial streets.

Other streets in the metropolitan area may be defined as a plurality of third axial streets; wherein when a third axial street is close to a first axial street, the third axial street is controlled in accordance with the first axial street, and when the third axial street is close to a second axial street, the third axial street is controlled in accordance with the second axial street.

The axial street may be a two-way street in which vehicles are not allowed to turn left. The axial streets may cross a plurality of sub-streets, such that the axial streets and the sub-streets are synchronized.

The vehicle average travel speed and the allowed travel time period for each control region may be identical, such that each control region has an identical size. Alternatively, the vehicle average travel speed and the allowed travel time period for each control region may be different, such that each control region has a different size.

The control region may be rectangular. The control regions may be aligned with the axial streets; or the control regions may be geographically aligned.

The traffic light may display a green light or a yellow light during the allowed travel time period.

A method further comprises: (J) defining a vehicle maximum speed limit Vmax based on the vehicle average travel speed and the following formula:

$$V_{max}=(1+A\,\%)\cdot V$$

wherein A % is a predetermined vehicle speed increasing ratio, which is defined according to road conditions; and V is the vehicle average travel speed.

Therefore, a symmetric and interlocked regional traffic light control method is provided for reducing metropolitan traffic jams to mitigate and/or obviate the aforementioned problems.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
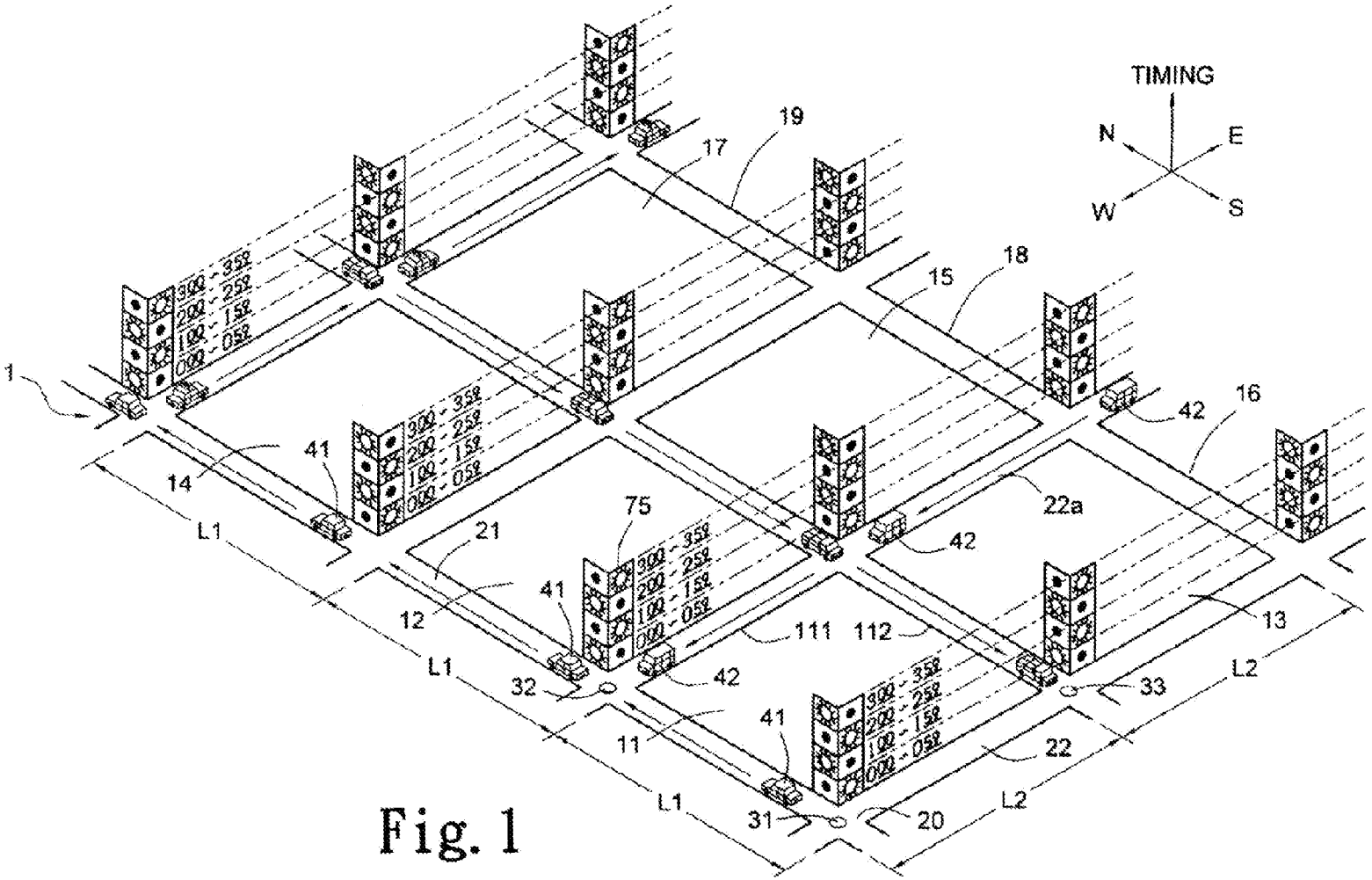
FIG. 1 is a schematic drawing of a first embodiment of the present invention.
Figure 2:
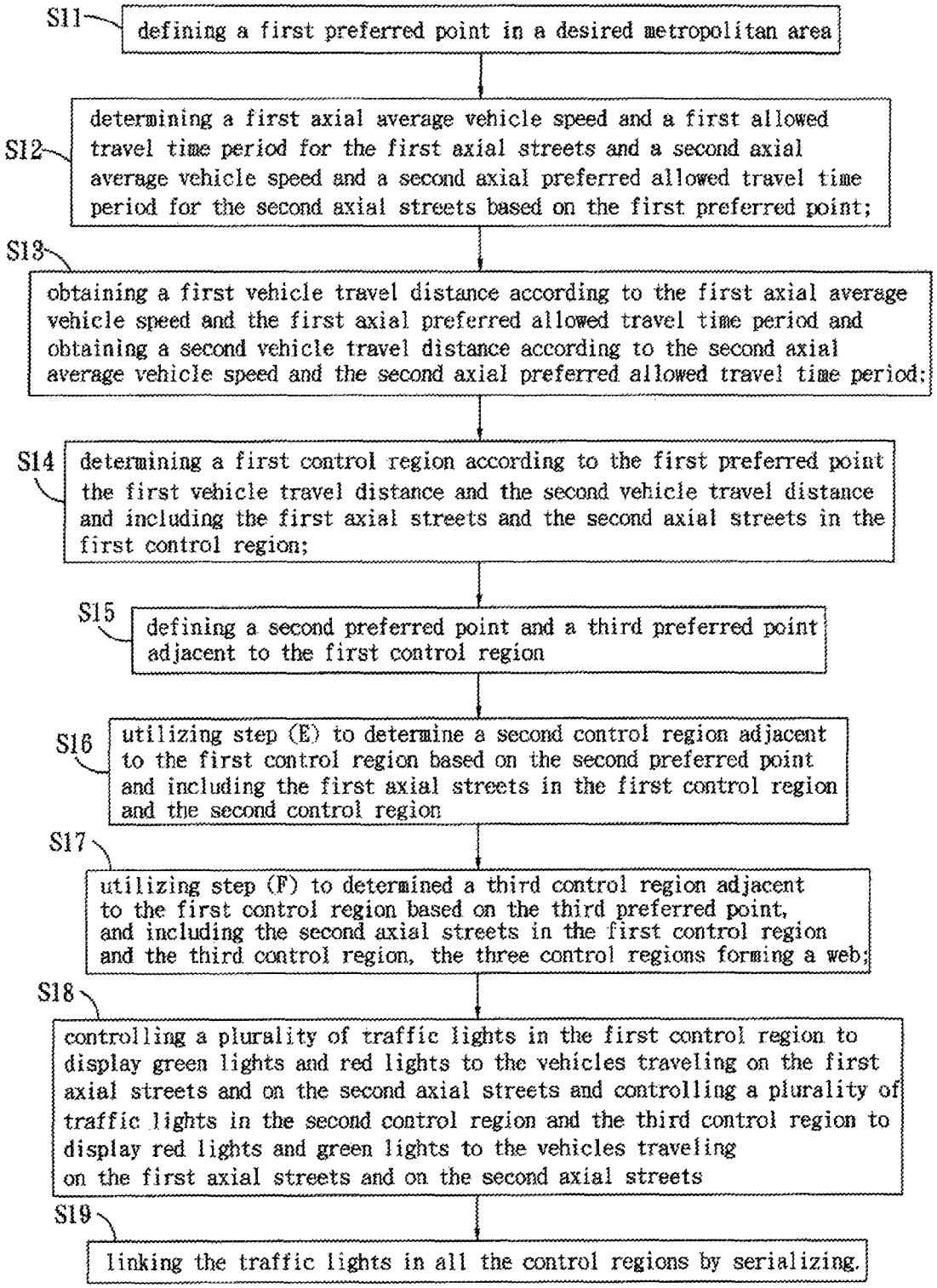
FIG. 2 is a flowchart of a method of the present invention.

Please refer to FIG. 1 and FIG. 2. FIG. 1 is a schematic drawing of a first embodiment of the present invention. FIG. 2 is a flowchart of an embodiment method of the present invention. In step S11, a first preferred point 31 and a preferred direction are defined in a desired metropolitan area 1, and the desired metropolitan area is divided into a plurality of first axial streets 21 and a plurality of second axial streets 22 based on the first preferred point and the preferred direction. The preferred direction can be geographic east, south, west or north; or it may be a direction of the first axial streets 21 or the second axial streets 22. In this embodiment, the preferred direction is geographic north which is also the direction of the first axial streets 21. The first preferred point 31 can be an intersection or a building. In this embodiment, the first preferred point is an intersection 20 of the first axial streets 21 and the second axial streets 22.

In step S12, a first axial average vehicle speed V1 and a first axial preferred allowed travel time period t1 for the first axial streets 21, and a second axial average vehicle speed V2 and a second axial preferred allowed travel time period t2 for the second axial streets 22, are determined based on the first preferred point 31. The first and second axial average vehicle speeds V1, V2 are an average vehicle speed including a starting speed, an acceleration speed, a deceleration speed and a stop speed of the vehicles on the first axial streets 21 and the second axial streets 22 and which also includes a safety factor and a vehicle efficiency factor. The first and second axial preferred allowed travel time periods t1, t2 are allowed travel times on the first axial streets 21 and the second axial streets 22, and are determined based on current traffic loads. In this embodiment, the first and second axial average vehicle speeds V1, V2 are 60 km/hr, and the first and second axial preferred allowed travel time periods t1, t2 are 60 seconds.

In step S13, a first vehicle travel distance L1 is obtained according to the first axial average vehicle speed V1 and the first axial preferred allowed travel time period t1, and a second vehicle travel distance L2 is obtained according to the second axial average vehicle speed V2 and the second axial preferred allowed travel time period t2. In this embodiment, since the first and second axial average vehicle speeds V1, V2 are 60 km/hr and the first and second axial preferred allowed travel time period t1, t2 are 60 seconds, the first vehicle travel distance L1 and the second travel distance L2 will be 1 km.

In step S14, a first control region 11 is determined according to the first preferred point 31, the first vehicle travel distance L1 and the second vehicle travel distance L2, and the first axial streets 21 and the second axial streets 22 are included in the first control region 11. Since the first vehicle travel distance L1 and the second vehicle travel distance L2 are equal to each other, the first control region 11 is square in shape.

In step S15, a second preferred point 32 and a third preferred point 33 are defined on two edges 111, 112 adjacent to the first control region 11. Furthermore, and the first axial streets 21 pass through the edges 111 and the second axial streets 22 pass through the edges 112.

In step S16, step S15 is repeated to determine a second control region 12 adjacent to the first control region 11 based on the second preferred point 32, and the first axial streets 21 are included in the first control region 11 and the second control region 12.

In step S17, step S16 is repeated to determine a third control region 13 adjacent to the first control region 11 based on the third preferred point 33, and the second axial streets 22 are included in the first control region 11 and the third control region 13, such that the three control regions 11, 12, 13 form a web.

In this embodiment, in step S17 and step S16, the first and second axial average vehicle speeds V1, V2 are 60 km/hr and the first and second axial preferred allowed travel time periods t1, t2 are 60 seconds, the first vehicle travel distance L1 and the second travel distance L2 of the second control region 12 and the third control region 13 will be 1 km, such that all three control regions 11, 12, 13 have the same size.

In this embodiment, step S15, step S16, and step S17 are repeated to determine a fourth, fifth, sixth, seventh, eighth, and ninth control region 14, 15, 16, 17, 18, 19. The control regions 11, 12, 13, 14, 15, 16, 17, 18, 19 are arranged as a web, such that the first axial streets 21 and the second axial streets 22 pass through every control region 11, 12, 13, 14, 15, 16, 17, 18, 19, and every control region 11, 12, 13, 14, 15, 16, 17, 18, 19 has a plurality of traffic lights 7 (as shown in FIG. 3) located at each intersection 20.

Figure 3:
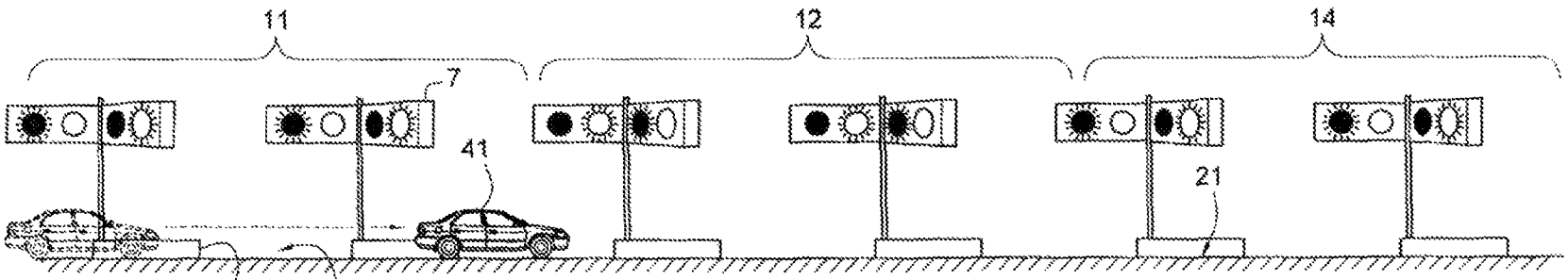
FIG. 3 is a state schematic drawing of axial streets, traffic lights and vehicles according to an embodiment of the present invention.

In step S18, the plurality of traffic lights 7 in the first control region 11 are controlled to display green lights to the vehicles traveling on the first axial streets 21 and red lights to the vehicles traveling on the second axial streets 22 according to the first axial preferred allowed travel time period t1 (as shown in FIG. 3). As shown in FIG. 1, all traffic lights in the first control region 11 display green lights to the vehicles traveling on the first axial streets 21 from the 0th second to the 59th second and red lights to the vehicles traveling on the second axial streets 22.

Furthermore, the plurality of traffic lights 7 in the second control region 12 and the third control region 13 are controlled to display red lights to the vehicles traveling on the first axial streets 21 and green lights to the vehicles traveling on the second axial streets 22 according to the second axial preferred allowed travel time period t2. As shown in FIG. 1, all traffic lights in the second and third control regions 12, 13 display red lights to the vehicles traveling on the first axial streets 21 from the 0th second to the 59th second and green lights to the vehicles traveling on the second axial streets 22. Therefore, all traffic lights 7 in the two adjacent control regions 11, 12 (or 11, 13) respectively display one type of traffic light signal to the axial streets.

In this embodiment, all traffic lights in the fourth, fifth, sixth and ninth control regions 14, 15, 16, 19 are respectively controlled to display green lights to the vehicles traveling on the first axial streets 21 according to the first axial preferred allowed travel time period t1 and to display red lights to the vehicles traveling on the second axial streets 22; and all traffic lights in the seventh and eighth control regions 17, 18 are respectively controlled to display red lights to the vehicles traveling on the first axial streets 21 according to the second axial preferred allowed travel time period t2 and to display green lights to the vehicles traveling on the second axial streets 22.

In step S19, the traffic lights on the control regions 11, 12, 13 on the same axial streets 21, 21 are linked by serializing the preferred allowed travel time periods t1, t2 to display either green lights or red lights in alternation in the control regions 11, 12, 13 together. For example, all traffic lights in the first control region 11 display red lights to the vehicles traveling on the first axial streets 21 and green lights to the vehicles traveling on the second axial streets 22 from 1 min 0th second to 1 min 59th second; meanwhile all traffic lights 7 in the second and third control region 12, 13 display green lights to the vehicles traveling on the first axial streets 21 from 1 min 0th second to 1 min 59th second and red lights to the vehicles traveling on the second axial streets 22 from 1 min 0th second to 1 min 59th second. In this embodiment, the traffic lights 7 in the control region 14, 15, 16, 17, 18, 19 on the control regions 11, 12, 13 on the same axial streets 21, 22 are linked by serializing the preferred allowed travel time periods t1, t2 to display either green lights or red lights in an alternating manner in the control regions 11, 12, 13 together.

In addition, the preferred allowed travel time periods t1, t2 include displaying a green light and a yellow light in sequence.

Figure 4:
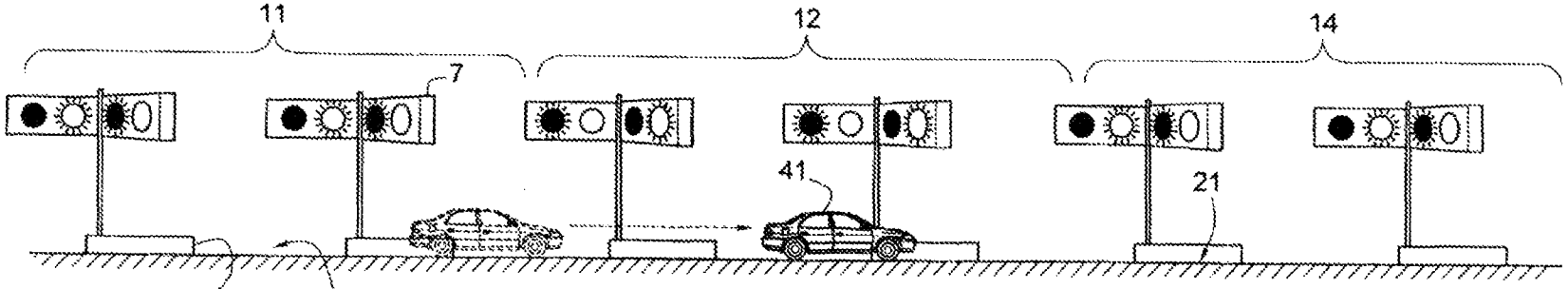
FIG. 4 is a schematic drawing of another state of FIG. 3.
Figure 5:
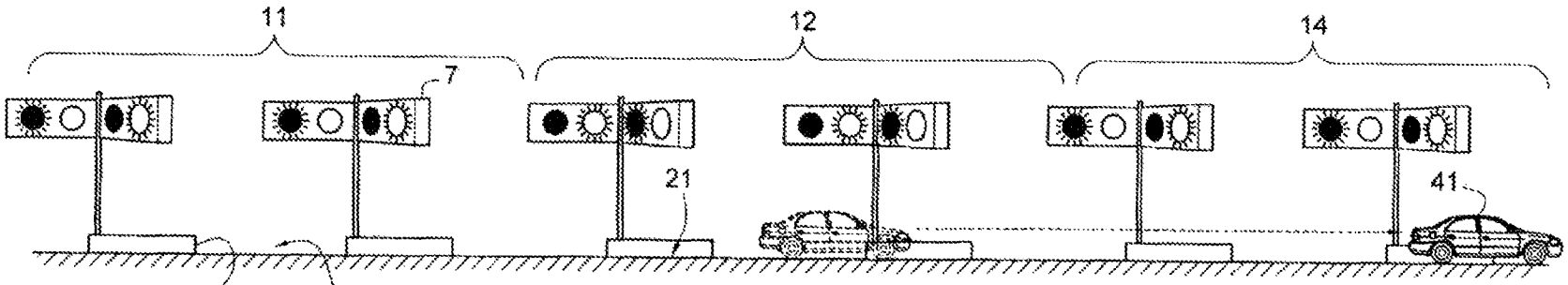
FIG. 5 is a schematic drawing of another state of FIG. 4.

Please refer to FIG. 1 again. A plurality of traffic light state blocks 75 for the traffic lights 7 are designed for each intersection 20, and two adjacent blocks 75 are one unit. The right block 75 shows the light state displayed by the traffic light 7 on the first axial streets 21, and the left block 75 shows the light state displayed by the traffic light 7 on the second axial streets 22. In the block 75, the white circle indicates a green light or a yellow light, and a black circle indicates a red light. Furthermore, numbers (such as 000~059) in the block 75 indicate a light signal display time. During the 0th second to the 59th second (as shown in FIG. 1), one vehicle 41 on first axial streets 21 in the first control region 11 moves with the first axial average vehicle speed V1 (60 km/hr), without any red lights, the vehicle enters into the second control region 12 at 1 min (as shown in FIG. 3); and one vehicle 42 on the second axial streets 22*a* in the eighth control region 18 moves with the second axial average vehicle speed V2 (60 km/hr), without any red lights, the vehicle 42 enters into the second axial streets 22*a* in the fifth control region 15 at the 1st min. The vehicle 41 moves through the second control region 12 (as shown in FIG. 4) from 1 min 0th second to 1 min 59th second, without any red lights, the vehicle 41 enters into the fourth control region 14 at the 2nd min (at shown in FIG. 5); and the vehicle 42 moves through the second axial streets 22*a* in the fifth control region 15, without any red lights, the vehicle 42 enters the second control region 12. The vehicle 41 moves through the fourth control region 14 from 2 min 0th second to 2 min 59th second, without any red lights, the vehicle 41 leaves the desired metropolitan area 1 at the 3rd min; and the vehicle 42 moves through the second control region 12, without any red lights, the vehicle 42 leaves the desired metropolitan area 1 at the 2nd min. Therefore, the vehicles 41, 42 can continuously move through the control regions 11, 12, 13, 14, 15, 16, 17, 18, 19 along the first axial streets 21 and the second axial streets 22, without any red lights.

The reasons for the vehicles 41, 42 needing to stop at red lights will be: speeding, driving too slow, car accidents, traffic jams, etc.

Figure 6:
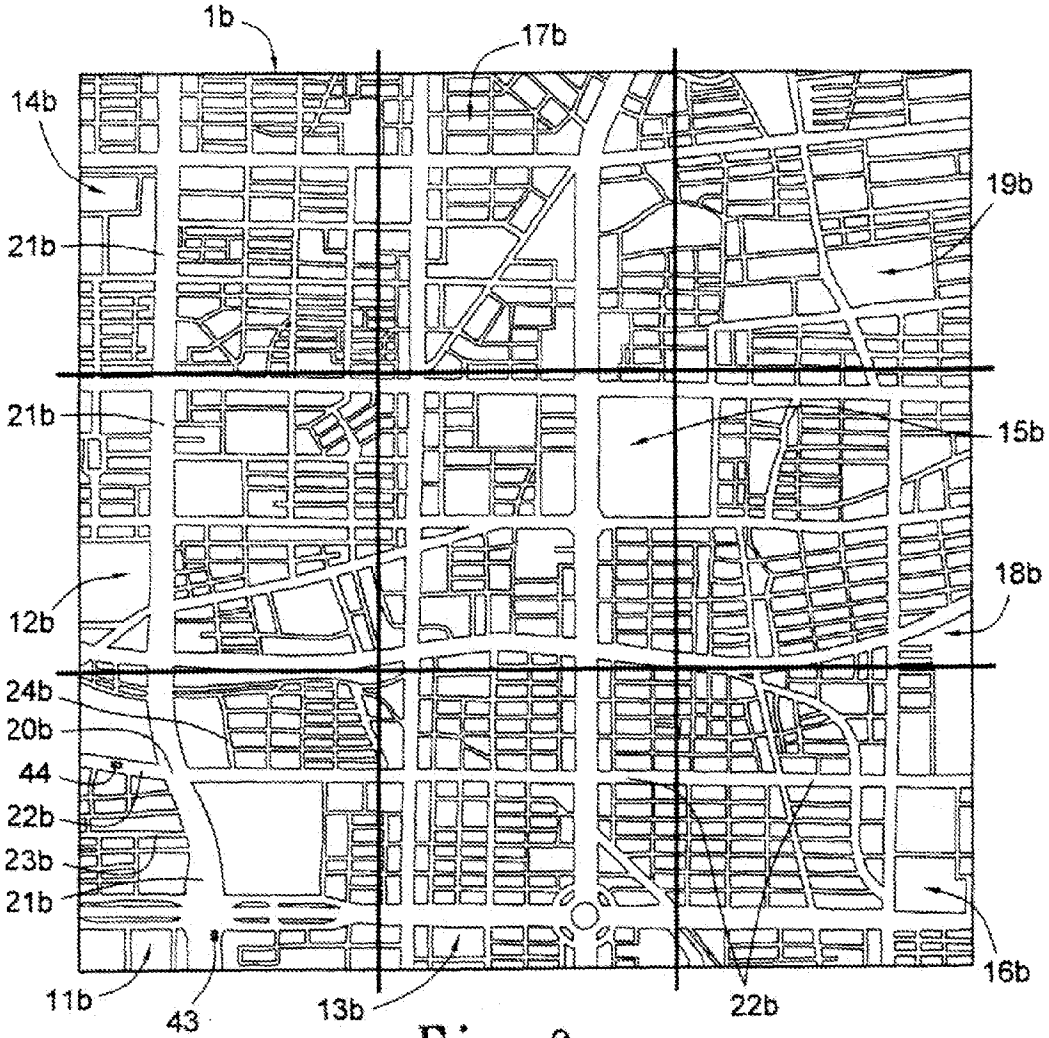
FIG. 6 is a schematic drawing of a second embodiment of the present invention.

Please refer to FIG. 6. FIG. 6 is a schematic drawing of a second embodiment of the present invention. A local map is divided into first, second, third, fourth, fifth, sixth, seventh, eighth, and ninth control regions 11*b*, 12*b*, 13*b*, 14*b*, 15*b*, 16*b*, 17*b*, 18*b*, 19*b*. Please refer to FIG. 7. All the traffic lights on the first axial streets 21*b* in the first, fourth, fifth sixth, and ninth control regions 11*b*, 14*b*, 15*b*, 16*b*, 19*b* shown in a thick black frame 51 are simultaneously controlled to display green lights and the all the traffic lights on the second axial streets 22*b* in the same control regions are simultaneously controlled to display red lights. All the traffic lights on the first axial streets 21*b* in the second, third, seventh, and eighth control regions 12*b*, 13*b*, 17*b*, 18*b* shown in a thick white frame 52 are simultaneously controlled to display red lights and the all the traffic lights on the second axial streets 22*b* in the same control regions are simultaneously controlled to display green lights.

Figure 7:
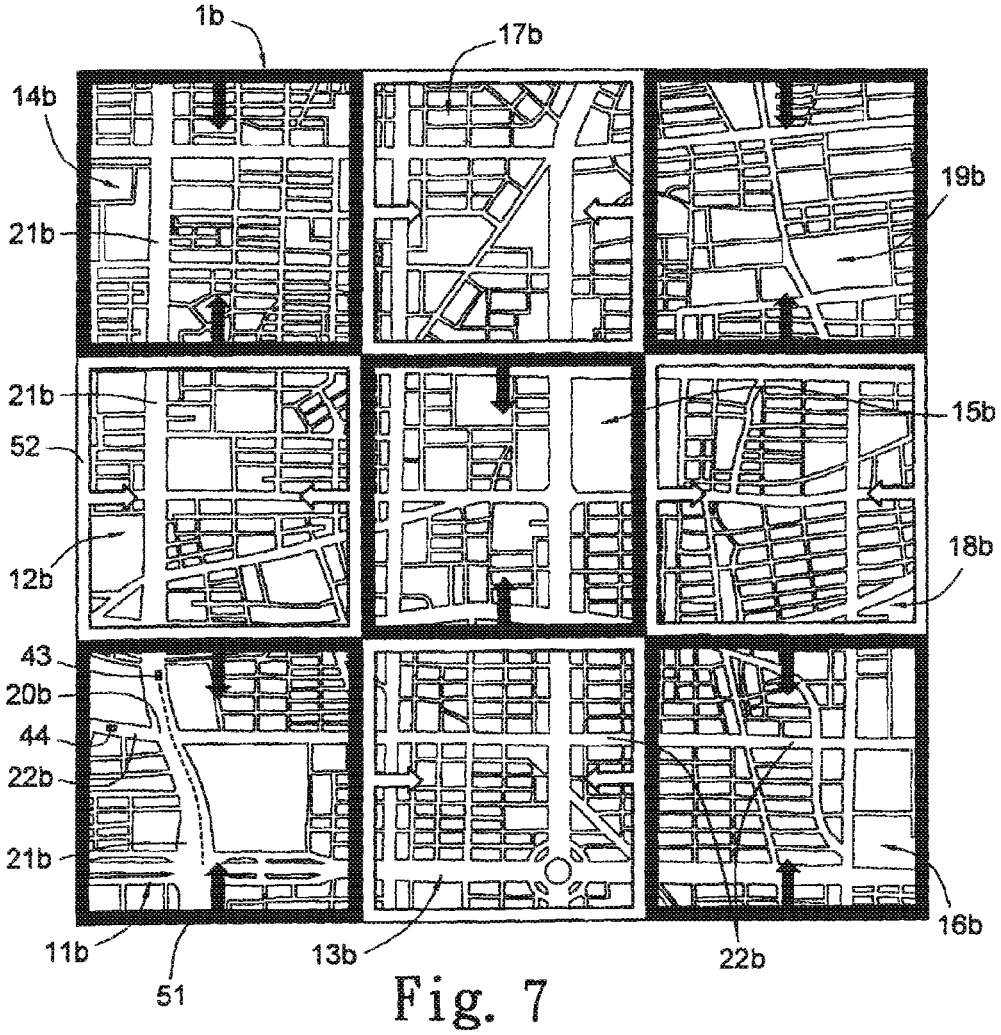
FIG. 7 is a schematic drawing showing the control regions shown in FIG. 6 in an alternate traffic control method.
Figure 8:
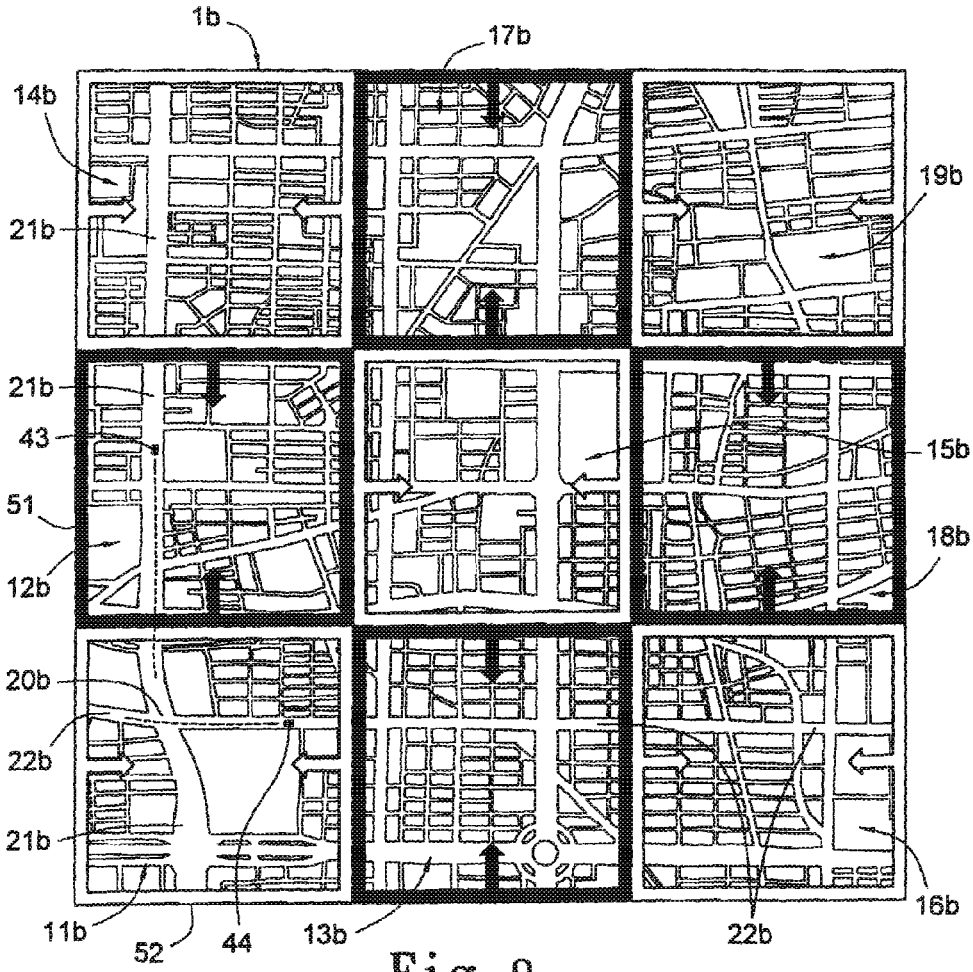
FIG. 8 is a schematic drawing of another state of FIG. 7.
Figure 9:
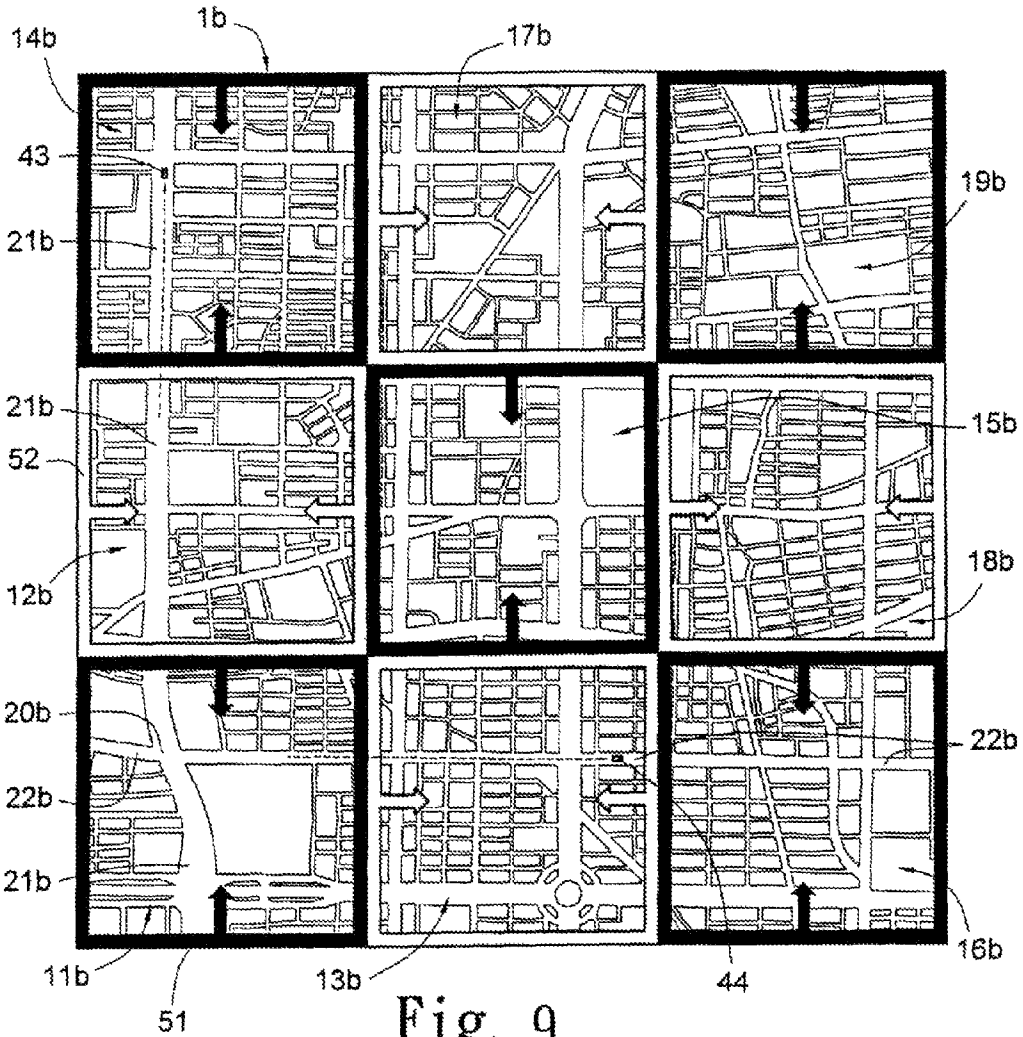
FIG. 9 is a schematic drawing of another state of FIG. 8.
Figure 10:
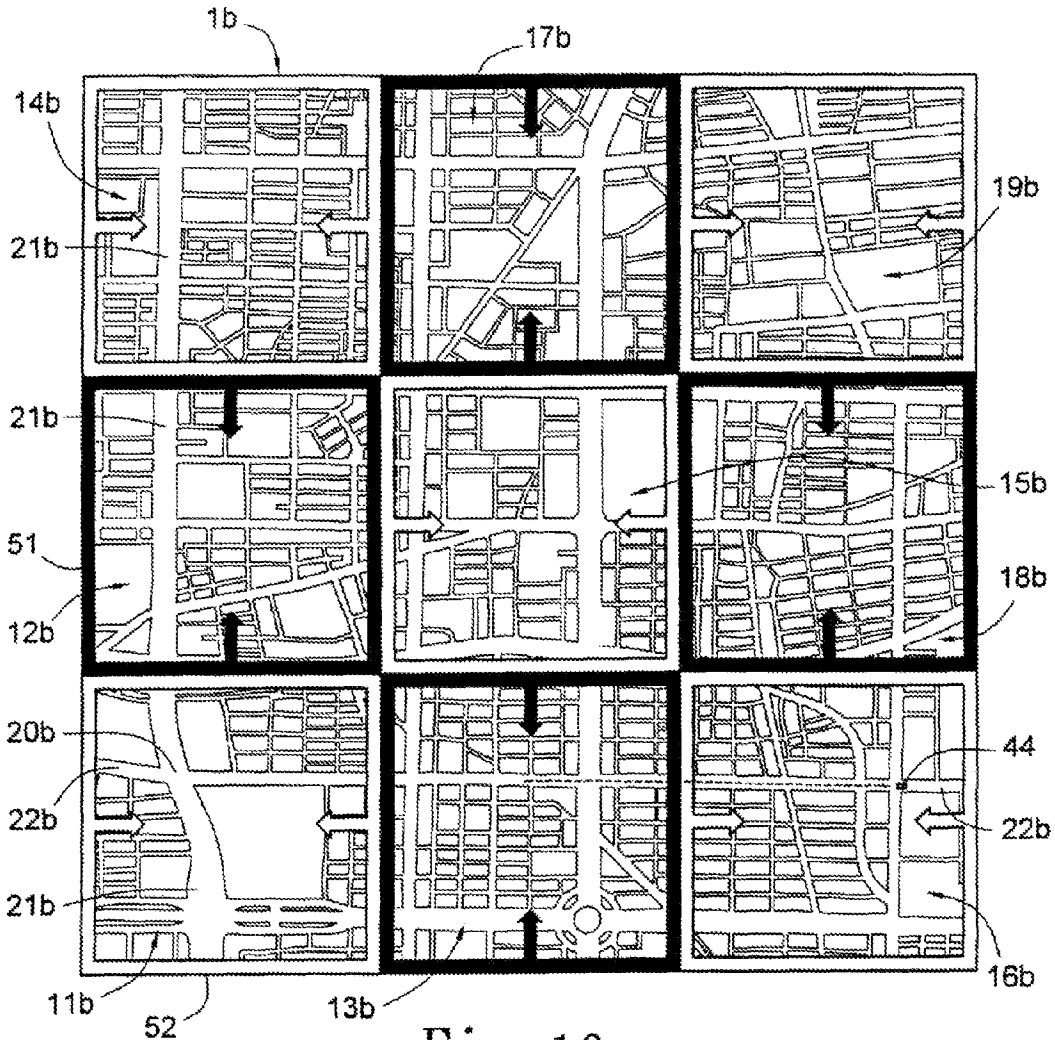
FIG. 10 is a schematic drawing of another state of FIG. 9.

During the 0th sec to the 59th sec (as shown in FIG. 7), a vehicle 43 moving along the first axial streets 21*b* in the first control region 11*b* has a first axial average vehicle speed V1 (60 km/hr), without any red lights, the vehicle 43 enters into the second control region 12*b* at 1 min (as shown in FIG. 8); and a vehicle 44 on the second axial streets 22*b* in the first control region 11*b* stop at the intersection 20*b* for the green light and let the vehicle 43 to pass through. Then, the vehicle 43 moves through the second control region 12*b* from 1 min 0th second to 1 min 59th second, without any red lights, the vehicle 43 enters into the fourth control region 14*b* at the 2nd min (at shown in FIG. 9); and the vehicle 44 moves with the second axial average vehicle speed V2 (60 km/hr), without any red lights, the vehicle 44 enters into the third control region 13*b* at the 2nd min. The vehicle 43 moves through the fourth control region 14*b* from 2 min 0th second to 2 min 59th second, without any red lights, the vehicle 43 leaves the desired metropolitan area 1*b* at the 3rd min (as shown in FIG. 10); and the vehicle 44 moves through the third control region 13*b*, without any red lights, the vehicle 44 enters into the sixth control region 16*b*. Finally, the vehicle 44 moves through the sixth control region 16*b* from the 3 min 0th second to 3 min 59th second, without any red lights, the vehicle 44 leaves the desired metropolitan area 1*b* at the 4th min.

In order to smooth traffic conditions, the present invention can also utilize the following conditions: the axial streets 21, 21*b*, 22, 22*b* can be two-way streets and employ no-left-turn signs.

The axial streets 21*b*, 22*b* and a plurality of sub-streets 23*b*, 24*b* (as shown in FIG. 6) are intercrossed with each other; the traffic light synchronization control method of the present invention is performed to the axial streets 21*b*, 22*b* and a plurality of sub-streets 23*b*, 24*b* according to the traffic load.

A vehicle maximum speed limit Vmax may be defined based on the vehicle average travel speed and the following formula:

$$V_{max}=(1+A\,\%)\cdot V \tag{1}$$

wherein A % is a predetermined vehicle speed increasing ratio, which is defined according to the road conditions; and V is the vehicle average travel speed.

Therefore, the first axial vehicle average travel speed V1 (wherein V1=V) is used to obtained the first axial vehicle average travel speed limit Vmax as follows:

$$V_{max}=(1+A\,\%)\cdot V_1 \tag{2}$$

When the second axial vehicle average travel speed $V_2$ (wherein $V_2$=V) may be used to obtain the second axial vehicle average travel speed limit $V_{max}$ as follows:

$$V_{max}=(1+A\,\%)\cdot V_2 \tag{3}$$

Wherein, A can be selected from a range 10 to 20, which is used for accommodating different unpredictable factors such as starting time, speeding, slow driving speeds, accidents on road, going through turns, etc.

Figure 11:
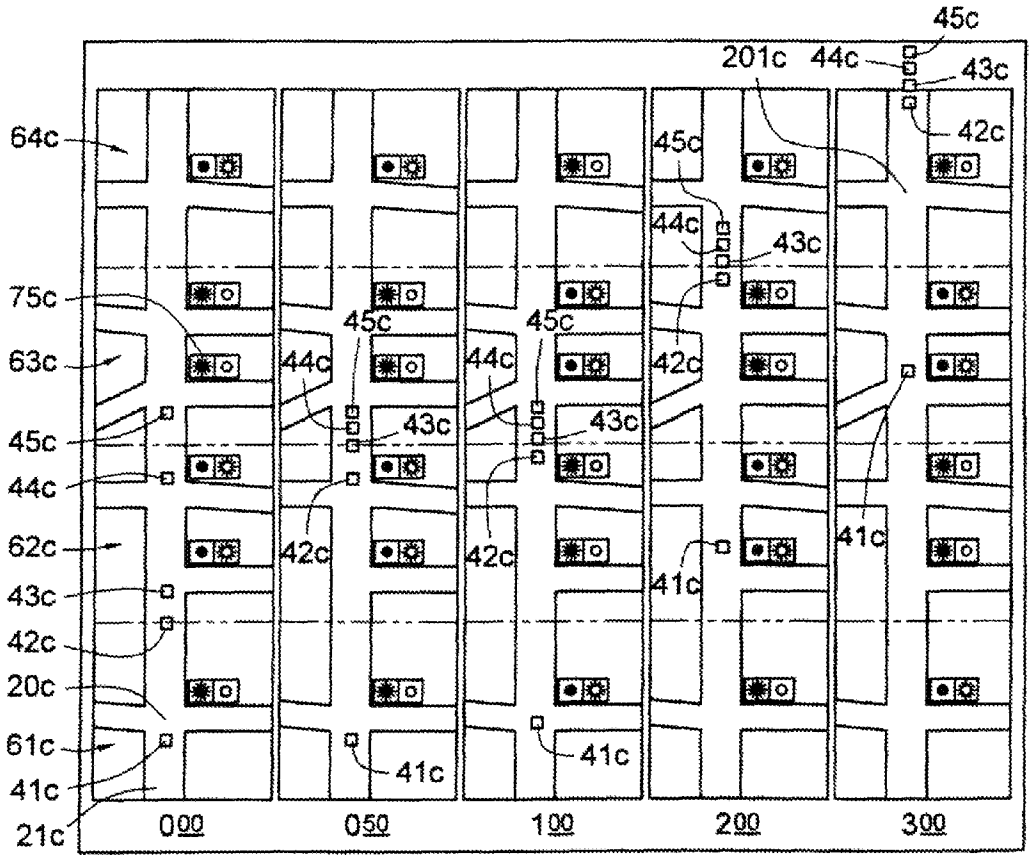
FIG. 11 is a schematic drawing of a third embodiment of the present invention.

Please refer to FIG. 11. FIG. 11 is a schematic drawing of a third embodiment of the present invention. The first axial streets 21*c* are divided into a control region A 61*c*, a control region B 62*c*, a control region C 63*c*, and a control region D 64*c*. A plurality of traffic light state blocks 75*c* for the traffic lights 7 are designed for each intersection 20*c*, and two adjacent blocks. In the left block 75*c*, the black circle indicates a red light, and in the right block 75 the white circle indicates a green light or a yellow light. Radial lines around the black circle and the white circle indicate that the corresponding traffic light is activated, and the numbers below each control region A 61*c* (such as 050) indicates a display time for the traffic lights in each control region 61*c*, 62*c*, 63*c*, 64*c*.

At the 0th second, two vehicles 41*c*, 45*c* respectively move along the first axial streets 21*c* in the control region A 61*c* and the control region C 63*c*; two vehicles 43*c*, 44*c* respectively move along the first axial streets 21*c* in the control region B 62*c*, and a vehicle 42*c* moves along the first axial streets 21*c* in the control region A 61*c* and the control region B 62*c*. All of the vehicles 41*c*, 42*c*, 43*c*, 44*c*, 45*c* move with the first axial vehicle average travel speed V1.

During the 0th sec to the 59th sec, all traffic lights in the first axial streets 21*c* in the control region A 61*c* and the control region C 63*c*, display red lights such that the vehicles 41*c*, 45*c* need to stop for a green light; and all traffic lights in the first axial streets 21*c* in the control region B 62*c* display green lights such that the vehicles 43*c*, 44*c* move into the control region C 63*c* and stop behind the vehicle 45*c*. The vehicle 42*c* moves through the control region B 62*c* and stops behind the vehicle 43*c*.

During the 1 min 0th sec to the 1 min 59th sec, all traffic lights in the first axial streets 21*c* in the control region A 61*c* and the control region C 63*c* display green lights such that the vehicles 42*c*, 43*c*, 44*c*, 45*c* move through the control region C 63*c* and the vehicle 41*c* moves through the control region A 61*c*. During the 2 min 0th sec to the 2 min 59th sec, all traffic lights in the first axial streets 21*c* in the control region B 62*c* and the control region D 64*c*, display green lights such that the vehicles 42*c*, 43*c*, 44*c*, 45*c* move through the control region D64*c* and the vehicle 41*c* moves through the control region B 62*c*.

Figure 12:
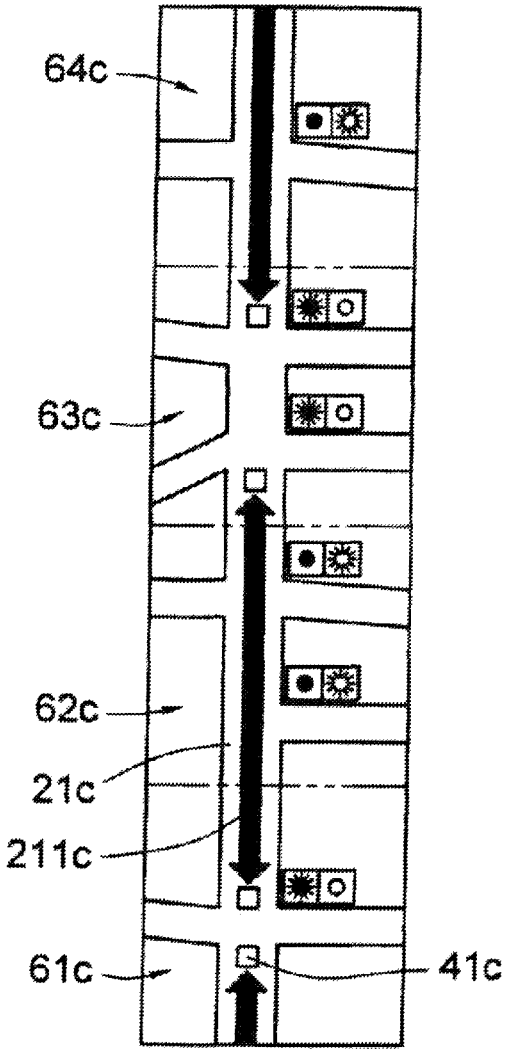
FIG. 12 is a schematic drawing of another state of FIG. 11.

During the 3 min 0th sec to the 3 min 59th sec, all traffic lights in the first axial streets 21*c* in the control region D 64*c* display red lights, but the vehicles 42*c*, 43*c*, 44*c*, 45*c* have already left the last intersection 201*c*; and all traffic lights in the first axial streets 21*c* in the control region C 63*c* display green lights such that vehicle 41*c* moves through the control region C 63*c*. Therefore, after several occurrences of light changes, the vehicles in the area naturally form into groups and move with the respective average speed. FIG. 11 shows the traffic flow moving towards the north direction, which can be applied to the other three directions. Even though all of the control regions 61*c*, 62*c*, 63*c*, and 64*c* have equal sizes, but in actual operation, when the traffic condition is good, a green light zone 211*c* extends from the control region 62*c* to both of the control regions 61*c* and 63*c* (as shown in FIG. 12). Accordingly, the green light zone 211*c* is extendable, which can improve traffic control.

Figure 13:
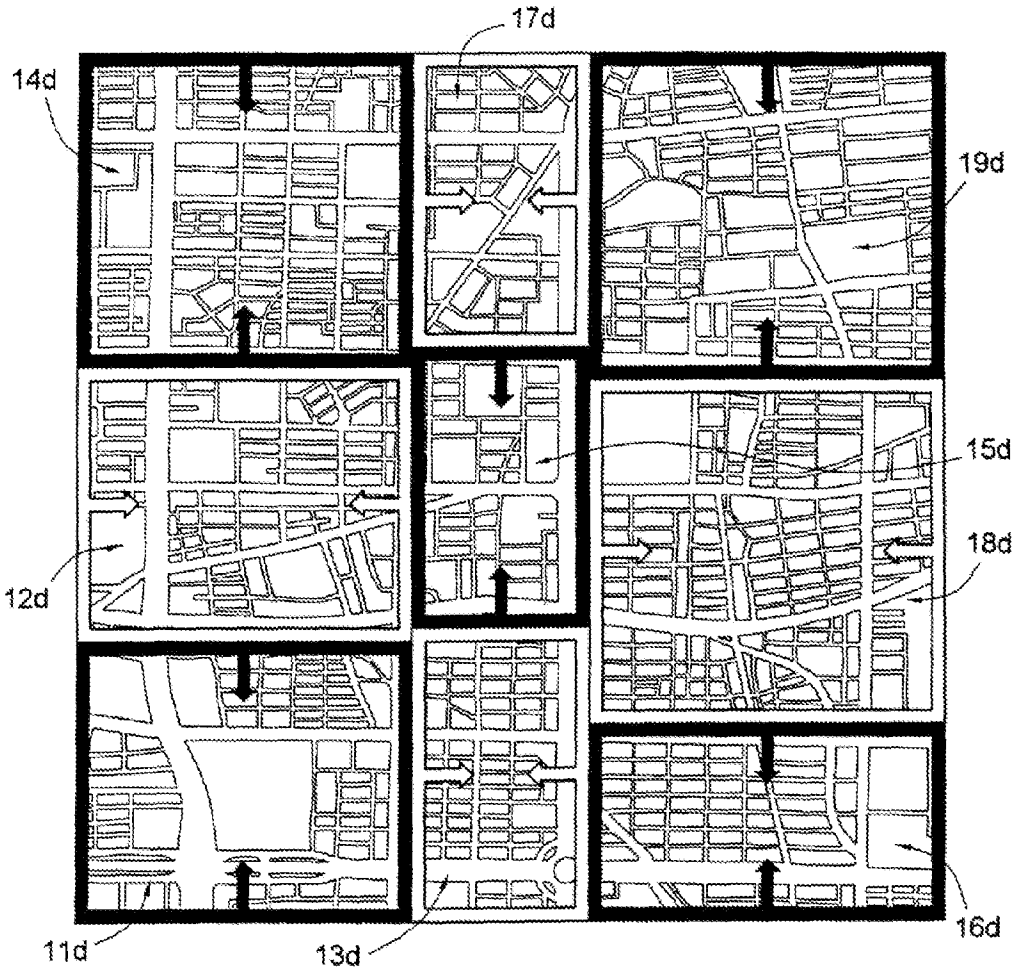
FIG. 13 is a schematic drawing of a fourth embodiment of the present invention.

Please refer to FIG. 13. FIG. 13 is a schematic drawing of a fourth embodiment of the present invention. The first and second axial vehicle average speeds V1, V2 and the first and second axial preferred allowed travel time periods t1, t2 can be adjusted based on the traffic conditions around the preferred points, such that the first and second axial vehicle average speeds V1, V2 and the first and second axial preferred allowed travel time periods t1, t2 for each of the control regions 11*d*, 12*d*, 13*d*, 14*d*, 15*d*, 16*d*, 17*d*, 18*d*, 19*d* can be different from one another. For example, if the first and second axial vehicle average speeds V1, V2 of the fifth control region 15*d* are 50 km/hr and 40 mk/hr, the first and second travel distances L1, L2 obtained in Step S13 are shorter, and the fifth control region 15*d* has a smaller size. If the first and second axial vehicle average speeds V1, V2 of the eighth control region 18*d* are 70 km/hr and 70 mk/hr, the first and second travel distances L1, L2 obtained in Step S13 are longer, and the eighth control region 18*d* has a larger size. Accordingly, when each vehicle moves with the predetermined vehicle average speed, it allows the traffic to flow smoothly.

Figure 14:
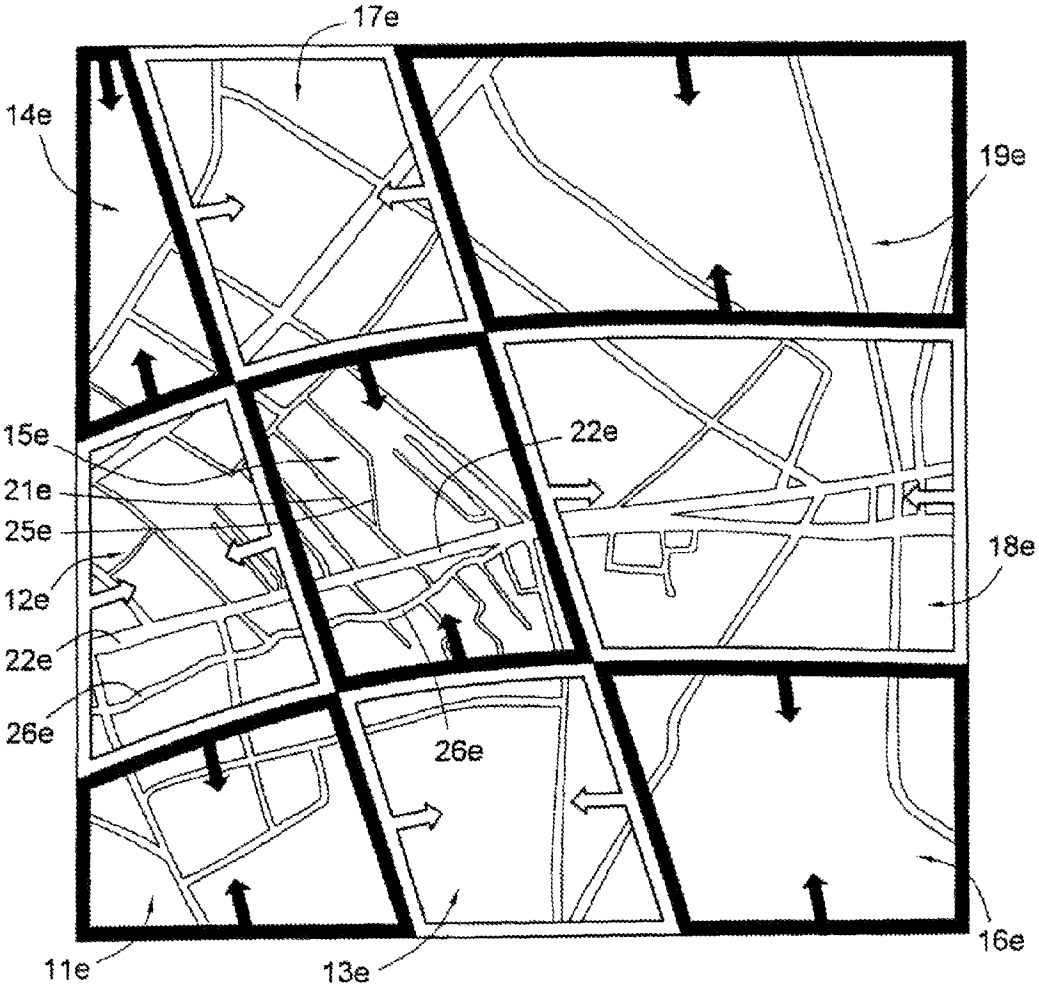
FIG. 14 is a schematic drawing of a fifth embodiment of the present invention.

Please refer to FIG. 14. FIG. 14 is a schematic drawing of a fifth embodiment of the present invention. The control regions 11*e*, 12*e*, 13*e*, 14*e*, 15*e*, 16*e*, 17*e*, 18*e*, 19*e* are aligned with the first and second axial streets 21*e*, 22*e* and geographically. Furthermore, the streets can also be defined as a plurality of third axial streets 25*e*, 26*e* located between the first and second axial streets 21*e*, 22*e*, which are streets having different angles. When the third axial street 25*e* is close to the first axial street 21*e*, the third axial street 25*e* is controlled in accordance with the first axial street 21*e*, and when the third axial street 26*e* is close to the second axial street 22*e*, the third axial street 26*e* is controlled in accordance with the second axial street 22*e*.

The control method can also be applied to a highway, and the axial vehicle average speeds V1, V2 and the preferred allowed travel time periods t1, t2 can be adjusted based on the traffic condition on the highway and related highways.

Therefore, the control method of the present invention is suitable for several control regions and may be used for synchronously controlling traffic lights for the control regions. Therefore, the vehicles in the control regions need only move with the axial vehicle average speeds V1, V2, to enter into the next control region and the next one, etc. Accordingly, the control method can reduce vehicle travel times, air pollution, noise pollution, and wasted fuel.

Figure 15:
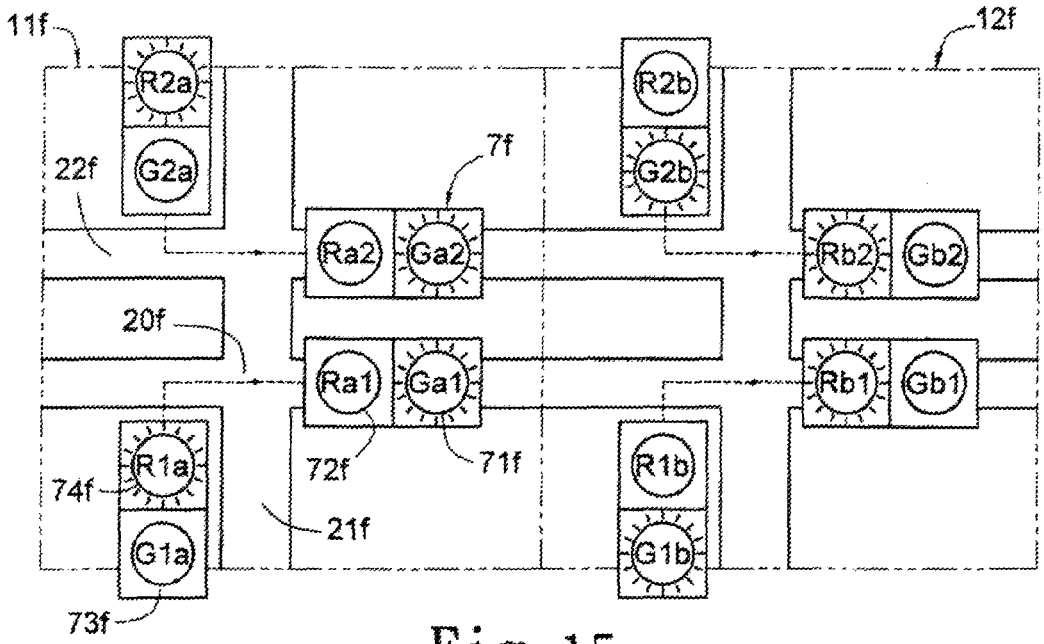
FIG. 15 is a layout schematic drawing of traffic lights in two control regions.
Figure 16:
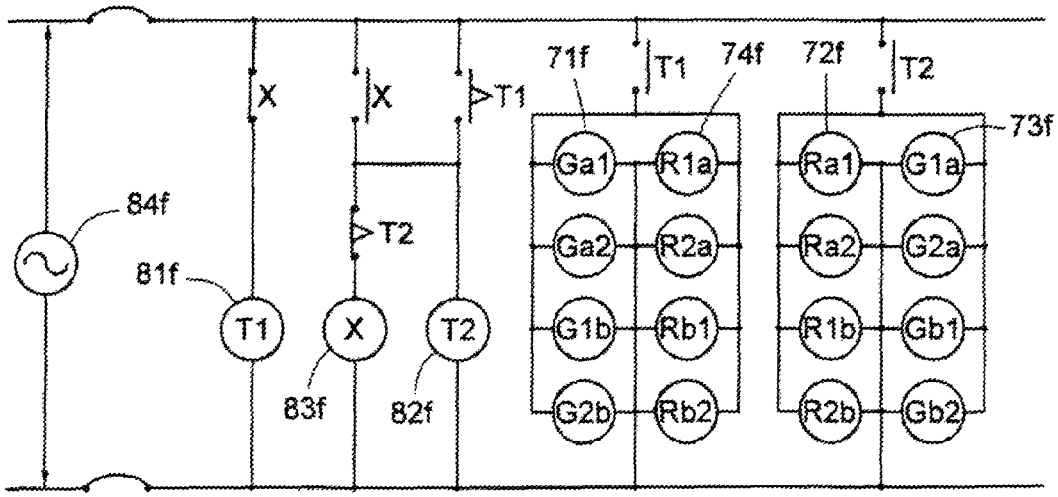
FIG. 16 is a control circuit drawing of traffic lights shown in FIG. 15.
Figure 17:
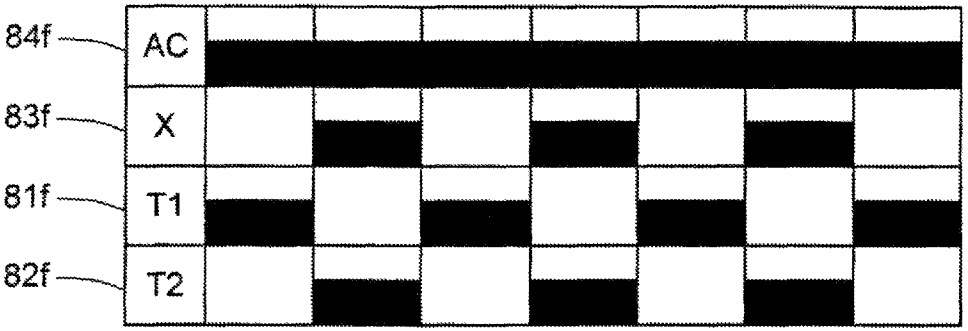
FIG. 17 is a timing diagram of each timer and auxiliary relay shown in FIG. 16.

Please refer to FIG. 15. FIG. 15 is a layout schematic drawing of the traffic lights 7*f* in the two control regions 11*f*, 12*f*. The traffic lights 7*f* are respectively placed at the cross-sections 20*f* of the first axial street 21*f* and second axial street 22*f*. Please refer to FIG. 16. FIG. 16 is a control circuit drawing of the traffic light 7*f* shown in FIG. 15. According to a circuit layout for a plurality of green lights 71*f*, 73*f* and a plurality of red lights 72*f*, 74*f*, the plurality of green lights 71*f*, 73*f* and the plurality of red lights 72*f*, 74*f* are connected to a AC power source 84*f*; the plurality of green lights 71*f*, 73*f* and the plurality of red lights 72*f*, 74*f* are connected in parallel to two timers T1, T2 (81*f*, 82*f*) and an auxiliary relay X (83*f*), and connecting points of the two timers T1, T2 are serially connected. Therefore, the plurality of green lights 71*f*, 73*f* and the plurality of red lights 72*f*, 74*f* can be controlled to perform symmetric and interlocked control to the two control regions 11*f*, 12*f*. Please refer to FIG. 17. FIG. 17 is a timing diagram for each timer and the auxiliary relay shown in FIG. 16. As shown in the drawing, each timer T1, T2 (81*f*, 82*f*) is alternatively switched to alternatively activate the plurality of green lights 71*f*, 73*f* and the plurality of red lights 72*f*, 74*f*.

Although the present invention has been explained in relation to its preferred embodiment, it is to be understood that many other possible modifications and variations can be made without departing from the spirit and scope of the invention as hereinafter claimed.

What is claimed is:

1. A regional traffic light symmetric and interlock control method comprising:

(A) defining a first preferred point in a desired metropolitan area, and dividing the desired metropolitan area into a plurality of first axial streets and a plurality of second axial streets based on the first preferred point;

(B) determining a first axial average vehicle speed and a first axial preferred allowed travel time period for the first axial streets and a second axial average vehicle speed and a second axial preferred allowed travel time period for the second axial streets based on the first preferred point;

(C) obtaining a first vehicle travel distance according to the first axial average vehicle speed and the first axial preferred allowed travel time period and obtaining a second vehicle travel distance according to the second axial average vehicle speed and the second axial preferred allowed travel time period;

(D) determining a first control region according to the first preferred point, the first vehicle travel distance and the second vehicle travel distance, and including the first axial streets and the second axial streets in the first control region;

(E) defining a second preferred point and a third preferred point adjacent to the first control region;

(F) utilizing step (E) to determine a second control region adjacent to the first control region based on the second preferred point, and including the first axial streets in the first control region and the second control region;

(G) utilizing step (F) to determine a third control region adjacent to the first control region based on the third preferred point, and including the second axial streets in the first control region and the third control region, the three control regions forming a web;

(H) controlling a plurality of traffic lights in the first control region to display green lights to the vehicles traveling on the first axial streets and red lights to the vehicles traveling on the second axial streets according to the first axial preferred allowed travel time period, and controlling a plurality of traffic lights in the second control region and the third control region to display red lights to the vehicles traveling on the first axial streets and green lights to the vehicles traveling on the second axial streets according to the second axial preferred allowed travel time period;

(I) linking the traffic lights in all the control regions by serializing whereby the plurality of traffic lights in the first control region are subsequently alternately controlled to display red lights to the vehicles traveling on the first axial streets and green lights to the vehicles traveling on the second axial streets according to the second axial preferred allowed travel time period, the plurality of traffic lights in the second control region and the third control region are controlled to display green lights to the vehicles traveling on the first axial streets and red lights to the vehicles traveling on the second axial streets according to the first axial preferred allowed travel time period and then step (H) is repeated; and (J) synchronously controlling a vehicle maximum speed limit Vmax based on a vehicle average travel speed within an axial street, wherein the vehicle maximum speed limit Vmax is determined by a function comprising:

$$V\max=(1+A\,\%)\cdot V,$$

wherein A % is a predetermined vehicle speed increasing ratio, which is defined according to a road condition, and V is the vehicle average travel speed within the axial street.

2. The method as claimed in claim 1, wherein the preferred point is an intersection or a building.

3. The method as claimed in claim 1, wherein the first axial streets and the second axial streets are divided from the first preferred point based on a preferred direction.

4. The method as claimed in claim 3, wherein the preferred direction is geographic east, south, west or north.

5. The method as claimed in claim 3, wherein the preferred direction is a direction of the first axial streets or the second axial streets.

6. The method as claimed in claim 1, wherein other streets in the metropolitan area are defined as a plurality of third axial streets; wherein when the third axial street is close to the first axial street, the third axial street is controlled in accordance with the first axial street, and when the third axial street is close to the second axial street, the third axial street is controlled in accordance with the second axial street.

7. The method as claimed in claim 1, wherein the axial street is a two-way street and vehicles are not allowed to turn left.

8. The method as claimed in claim 1, wherein the axial streets cross a plurality of sub-streets, such that the axial streets and the sub-streets are synchronized.

9. The method as claimed in claim 1, wherein the vehicle average travel speed and the allowed travel time period for each control region are identical, such that each control region has an identical size.

10. The method as claimed in claim 1, wherein the vehicle average travel speed and the allowed travel time period for each control region are different, such that each control region has a different size.

11. The method as claimed in claim 1, wherein the control region is rectangular.

12. The method as claimed in claim 1, wherein the control regions are aligned with the axial streets.

13. The method as claimed in claim 1, wherein the control regions are geographically aligned.

14. The method as claimed in claim 1, wherein the traffic light displays a green light or a yellow light during the allowed travel time period.

* * * * *